United States Patent [19]

Haissig et al.

[11] Patent Number: 4,520,860

[45] Date of Patent: Jun. 4, 1985

[54] HORIZONTAL CONTINUOUS CASTING APPARATUS

[75] Inventors: Manfred Haissig, 31 Foxhill, Irvine, Calif. 92714; Josef Lothmann, Langerwehe, Fed. Rep. of Germany

[73] Assignee: Manfred Haissig, Irvine, Calif.

[21] Appl. No.: 470,269

[22] Filed: Feb. 28, 1983

[51] Int. Cl.[3] ..... B22D 23/00; B22D 11/128

[52] U.S. Cl. ..... 164/415; 164/440; 222/600; 222/603

[58] Field of Search ..... 164/488, 489, 490, 437, 164/438, 439, 440, 415, 475, 484; 222/603, 600, 152; 266/138

[56] References Cited

U.S. PATENT DOCUMENTS

| | | | |
|---|---|---|---|
| 3,731,912 | 5/1973 | Kutzer | 222/600 |
| 3,809,146 | 5/1974 | Andrzajak et al. | 164/488 X |
| 3,918,613 | 11/1975 | Shapiand, Jr. | 222/600 X |
| 4,179,046 | 12/1979 | Jeschke et al. | 222/603 X |
| 4,429,816 | 2/1984 | Thrower | 222/603 |

FOREIGN PATENT DOCUMENTS

| | | | |
|---|---|---|---|
| 215611 | 6/1961 | Austria | 164/440 |
| 1181408 | 6/1959 | France . | |

*Primary Examiner*—Kuang Y. Lin
*Assistant Examiner*—Richard K. Seidel
*Attorney, Agent, or Firm*—Brumbaugh, Graves, Donohue & Raymond

[57] ABSTRACT

In a horizontal continuous casting plant having a horizontally oriented discharge duct for conveying molten metal from a container to the casting mold, a closure assembly for selectively blocking the flow of molten metal is provided in the duct. The closure assembly comprises a stationary headplate and a vertically disposed slider plate, the latter movable across the headplate between positions blocking and unblocking the flow of metal. To prevent solidification of metal around the closure when in the blocked position, gas supply means are provided in the headplate and slider plate to create a flow of gas at the closure that inhibits solidification and keeps the molten metal from penetrating between the fixed and movable parts of the closure assembly. The gas supply means comprises a plurality of nozzle openings in either the headplate or slider plate or both, connected with a source of gaseous media, and oriented substantially tangentially of and at an angle to the juncture of the headplate and slider plate. To counteract the differential ferrostatic pressure over the vertical face of the slider plate, more nozzle openings are provided in the lower half of the closure member than in the upper half. Variations of the basic arrangement include a porous plug inserted in the slider plate, in place of the upper nozzle openings, for enabling a distributed gas flow over the upper portion of the plate surface and a circular recess in the slider plate with nozzle openings disposed about the periphery of the recess.

6 Claims, 5 Drawing Figures

HORIZONTAL CONTINUOUS CASTING APPARATUS

BACKGROUND OF THE INVENTION

This invention relates to apparatus for the horizontal continuous casting of metals, in particular steels.

Such apparatus customarily encompasses a container for the molten metal which has a discharge nozzle in the lower region of its wall through which the metal flows into a substantially horizontally arranged ingot mold out of which the metal strand is drawn off, generally by mechanical means. The molten metal is conducted out of the container into the mold through a discharge duct that may be, for example, in the form of a mouthpiece made of refractory material integral with the container and extending into the mold.

In the practice of continuous horizontal strand casting, it is sometimes necessary or desirable to interrupt the casting cycle rapidly, for instance, upon changing over to another product, to replace the mold while the container is filled with metal, or to perform repair work on the mold.

Thus, for instance, the French Pat. No. 1,181,408 discloses apparatus in which a container for the molten metal is connected via a vertical discharge opening with a horizontally arranged casting duct directly followed by a horizontal mold. The heatable casting duct situated beneath the discharge opening has an opening in the side away from the casting mold, and is designed to accommodate a horizontally displaceable closure plug that passes through said opening and that blocks or unblocks the vertical discharge opening of the molten metal container and the casting duct as desired in each given case. With the closure in the unblocked or opened state, the molten metal flows vertically out of the molten metal container and, by sharply changing direction, into the horizontally arranged casting duct and the subsequent continuous casting mold. If the flow of metal is to be interrupted, the closure plug, adapted to the internal shape of the casting duct, is pushed horizontally into the casting duct and closes the opening between the molten metal container and the casting duct, as well as the casting duct itself.

Such a simply designed horizontally working closure element has drawbacks in that, upon closing, a relatively large amount of metal is displaced and no means are provided for preventing clogging of the passage from the molten metal container to the casting duct, with the result that greater radiation and cooling of solidified metal remnants occur at that point, causing trouble in the operation of the closure element.

To alleviate these drawbacks in continuous casting plants with vertically arranged casting molds and horizontal slider plates arranged to close vertical discharge ducts, means have been developed to prevent solidification of the metal in the area of the shutoff element.

In the arrangement described in U.S. Pat. No. 3,809,146, the slider plate is designed as a divided unit and includes a porous segment corresponding substantially to the size of the discharge nozzle between the molten metal container and the mold. In the closed position of the slider plate, the porous segment is aligned with the discharge nozzle and coupled through a line to a gas supply. The gas is distributed through the porous segment and, by generating rising bubbles, maintains the molten metal permanently in movement, and prevents its pénetration into readily cloggable areas and portions of the slider.

If the molten metal is hot and sufficiently fluid, an inert gas, such as, e.g., argon is introduced to achieve the desired displacement of the metal away from sensitive areas of the slider. If there is a risk of solidifying of the metal in the area of the discharge nozzle and the slider as a result of cooling, oxygen or oxygen-containing gas is substituted for the inert gas, whereby heating of the metal occurs in this area as a result of the oxidation of a small portion of the metal, thereby preventing solidification of parts of the metal in the area of the slider plate that is to retain its movability. Effective introduction of the gases is achieved without problems since, because of the horizontal disposition of the slider plate and the surface of the porous gas supply portion, the ferrostatic pressure of the metal situated above the slider in the container is uniform over the entire cross-section of the discharge nozzle.

However, in horizontal continuous casting plants where the closure means for interrupting the flow of molten metal from a horizontally disposed discharge nozzle comprises a vertically disposed sliding member, the ferrostatic pressure is not uniform over the entire cross-section of the discharge nozzle, there being a higher static pressure at the lower part of the sliding member than at its upper portion, giving rise to problems in avoiding unwanted solidification of the metal when the discharge nozzle is closed.

SUMMARY OF THE INVENTION

It is the principal object of the invention to provide a device for a horizontal continuous casting arrangement, which includes a closure element for interrupting the flow of molten metal constituted by a substantially vertically arranged slider, and which, to avoid problems in the area of the closure element, includes means for supplying an inert or oxygen-containing gas in a manner which overcomes the effect of non-uniform ferrostatic pressure noted above.

The object of the invention is realized, in apparatus for the continuous casting of metals, in particular steels, which encompasses a container for the molten metal to be cast, at least one horizontally oriented discharge duct in the area of the bottom of the container connected with at least one horizontal continuous casting mold, and at least one closure element including a vertically disposed slider plate arranged in the duct, characterized in that there is provided in either or both of a stationary headplate having a borehole through which molten metal flows and a slider plate for blocking said borehole at least one substantially tangentially directed nozzle opening for discharging an inert or oxygen-containing gas.

Preferably a plurality of such nozzle openings having a tangential outflow direction are provided in each of said headplate and slider plate, discharging the gaseous medium around the periphery of the borehole in the headplate and the area at which the borehole meets the slider plate. The gas inputs can be formed also by capillaries, ducts, or the like. By "tangential" is meant that the gases do, on the one hand, leave the respective surface of the one of the said parts of the closure assembly tangentially or at a flat or an acute angle, and on the other, that their direction of outflow runs in each case substantially parallel to the corresponding part of the boundary line of the area to be contacted by the gas. In spite of the fact that it is substantially tangential, the direction of outflow can be oriented advantageously toward the outside, in other words, even toward the periphery of the arrangement.

What has been found to be most important is to supply the gases at the periphery of the respective parts of the closure assembly. Additionally, a supply of gas may also be provided over the central area, for instance, of the slider plate.

In accordance with the invention in the area of the generally circular marginal zone of the surface region of the slider plate that is in contact with the molten metal, there are provided a plurality of nozzle openings, preferably tangentially directed, that traverse the surface of the slider plate at an acute angle of from 3 to 45 degrees and preferably in the range of 10 to 30 degrees.

It is advantageous further that the nozzle openings in the wall of a borehole passing through the headplate, in the area facing the adjoining slider plate, are arranged substantially tangentially of the borehole, with a discharge direction oriented against the surface of the slider plate, forming an angle of from 3 to 75 degrees, preferably between 10 to 60 degrees.

It will be understood that in accordance with the invention, gas discharge nozzle openings may be provided in either the headplate or the slider plate, or in both. In all of these embodiments, the penetration of molten metal between the displaceable and fixed parts of the closure assembly as well as solidification of metal at these sites is reliably eliminated even if the molten metal should have cooled excessively.

According to the invention, provision can be made that all nozzle openings on the headplate and/or the slider plate have a unidirectional discharge orientation. This engenders an orbital motion of the molten metal tending to keep the metal away from the area of the slider. In such an arrangement the nozzle openings in the slider plate may all have one unidirectional discharge orientation while the nozzle openings in the headplate may all have one unidirectional discharge orientation that is opposite to the discharge orientation of the nozzle openings in the slider plate.

In another embodiment, the nozzle openings on the headplate and the slider plate may be oriented such as to bring about peripheral convection flow of the molten metal around the inner wall of the borehole in the headplate.

In a further arrangement in accordance with the invention that enhances the uniformity of the gas flow across the headplate and slider plate surfaces and thereby the movement of the metal in the overall area of the slider, there are provided, in the lower area, preferably in the lower half of the surface region of the slider plate in contact with the molten metal and/or in the lower area of the openings of the headplate, 10 to 100% more nozzle openings than in the respective upper areas, preferably in the upper halves of these surface regions.

To assist the effect of the tangential nozzle openings on the headplate and/or the slider plate, an insert or plug of porous material may be provided to which a supply of the gaseous medium is coupled. The porous insert preferably is offset from the center of the slider plate, towards the upper part of the plate and at its surface such that, in the closed position of the slider plate, the insert is in contact with the molten metal. The gas supplied through the insert enables fewer tangential nozzles to be used in the slider plate, only those in the lower half of the slider plate being necessary.

A further embodiment of the invention comprises a slider plate having a cylindrically formed recess in its surface facing the molten metal and covering most of its area. The boundary wall of the recess is traversed by nozzle openings for the supply of gaseous media having a discharge flow that is substantially tangential and oriented against the molten metal.

BRIEF DESCRIPTION OF THE DRAWINGS

The invention is explained below in greater detail with reference to the drawing in which.

DETAILED DESCRIPTION

Figure 1:
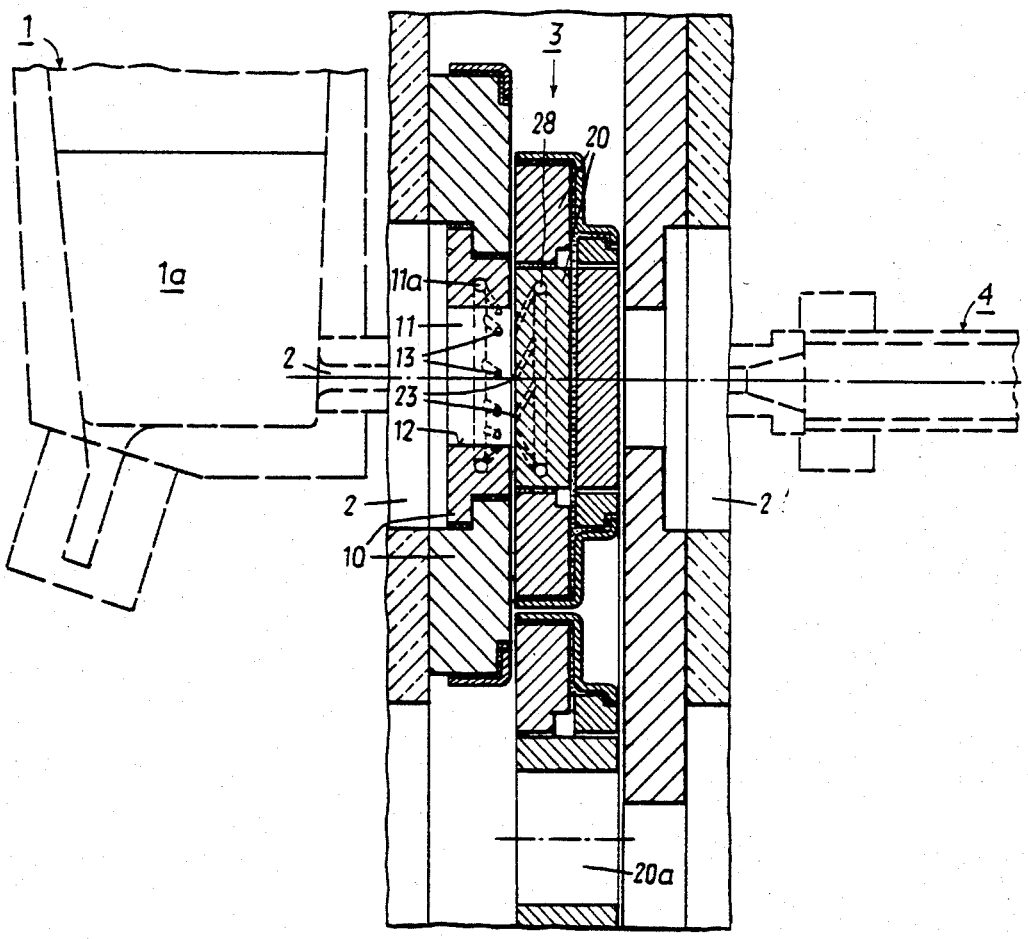
FIG. 1 is an overall schematic of the apparatus according to the invention, in which gas can be tangentially supplied via both the headplate and the slider plate of the slider, with the closure assembly and a portion of the surrounding elements enlarged for greater clarity.

Referring to FIG. 1, the container 1 (shown in part) for the molten metal 1*a* to be cast has in its lower area a substantially horizontally oriented discharge duct 2 connecting with the horizontally disposed continuous casting mold 4 (also shown in part). A closure assembly 3 in the ducts includes a stationary headplate 10 and a divided slider plate. The latter includes a first section 20 which, when in the position shown in FIG. 1, blocks the flow of molten metal to the mold 4, and a second section having a bore 20*a* of the same diameter as the discharge duct 2 and which when aligned with the duct 2 permits the flow of molten metal to the mold. The slider plate may be moved from one position to the other by any suitable means, such as a hydraulically actuated piston-cylinder arrangement, not shown.

The stationary headplate 10, made of highly refractory material, is arranged on the side of the closure assembly facing the molten metal container and has a thruput opening 11 for the flow of molten metal. The peripheral wall 12 of the opening 11 is penetrated by a plurality of gas supply nozzles 13 having a substantially tangential direction of discharge. The gaseous medium, either an inert gas, e.g., argon, or oxygen (or oxygen-containing gas) is selectively applied via an annular conduit 11*a* formed in the leadplate to the nozzles 13. The gas emerging from the nozzles 13 displaces the molten metal continuously out of the area of the slider plate 20.

In the closed position shown, the displaceable slider plate section 20 is disposed snugly against the headplate 10. The slider plate section 20 likewise is made of refractory material, retained for structural rigidity by a metal shell. The slight spacing shown between the slider plate and the fixed members on either side of it is only to indicate that the former is movable. Actually it is in close sliding contact with both members.

The area of the slider plate section 20 that, in the closed position, is in contact with the molten metal 1*a* from in the container 1, includes a plurality of tangentially entering nozzles 23 which, via an annular duct 28 are supplied with the pressurized inert or oxygen-containing gas. The tangentially outflowing gas keeps the molten metal in movement in the region of the slider plate 20 and displaces it continuously out of its region. The nozzles in the slider plate 20 are arranged in a generally circular pattern on a diameter somewhat within the periphery of the opening 11 in the headplate.

Figure 2:
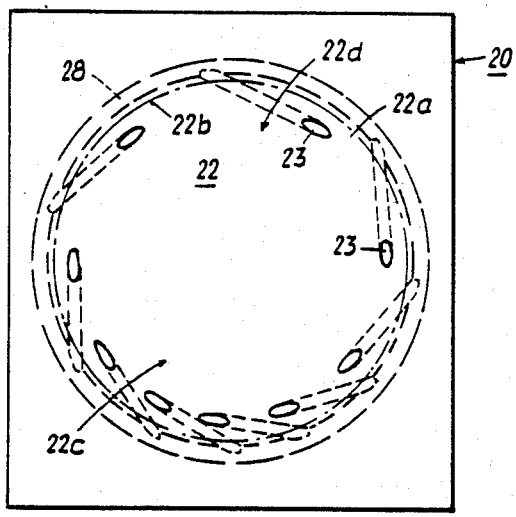
FIG. 2 is a front view of the surface of a slider plate in accordance with the invention with nozzles having a tangential discharge flow, which surface, in the closed position, is in contact with the molten metal situated in the molten metal container.

In FIG. 2 a front view of a portion of the slider plate 20 is shown. The area 22, defined by the dash-dot circular line 22*b*, corresponds to the area of the opening 11, and in the closed position of the slider plate 20, is in contact with the molten metal 1*a*.

The discharge openings of the nozzles 23 for the tangential supply of the gases are disposed in the marginal zone 22*a* of this area 22. Gas is supplied to the nozzles via the annular conduit 28. In the case of the arrangement illustrated in FIGS. 1 and 2, a greater number of tangential nozzles (e.g., 10 to 100% more) is arranged in the lower region 22*c* than in the upper region 22*d*. There is achieved thereby good compensation for the differences in ferrostatic pressure occurring along the cross-section of the horizontal discharge duct 2 (FIG. 1), and thus a uniform supply of gaseous medium over the sensitive area of the slider.

Figure 3:
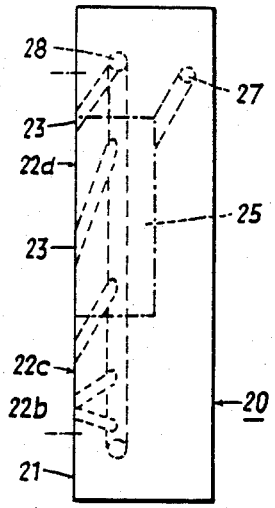
FIG. 3 is a side view of the slider plate of FIG. 2 showing the orientation of the nozzles and a porous insert provided therein.

The side view of the plate 20 (FIG. 2) illustrated in FIG. 3, shows the nozzle openings 23 penetrating the surface 21 at an acute angle, the marginal zone 22*a* of the surface region 22 and the disposition of the annular gas supply duct 28. Also illustrated in FIG. 3 is a porous plug or insert 25 (illustrated in dash-dot lines) that is upwardly offset with respect to the center of the region 22, is surrounded by the nozzle openings 23, and seated in a recess of the slider plate 20. Gases are fed to the porous plug 25 through feeder line 27, and introduced laminarly and very finely distributed into the molten metal 1*a*. The plug 25 may be formed, for example, of zirconium oxide.

Figure 4:
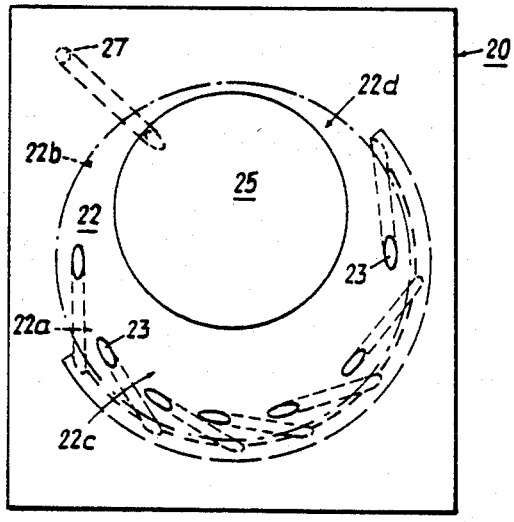
FIG. 4 is a schematic front view of a slider plate including fewer nozzles and a porous plug for the supply of gas to the contact area of the slider plate and, FIG. 5 is a cross-section through a slider plate provided with a recess, with the gases being fed tangentially out of the boundary wall to this recess.

In the embodiment of the slider plate, illustrated in front view in FIG. 4, a porous plug 25 is likewise disposed in the upper partial region 22*d* of the slider 20. However, no tangential gas supply nozzles are arranged there in this upper portion, their function being taken over by the porous plug 25. On the other hand, in the lower area 22*c*, gas supply nozzles 23 having the tangential discharge orientation essential for the invention are disposed to insure the uniform flow of gas across the overall cross-section.

Figure 5:
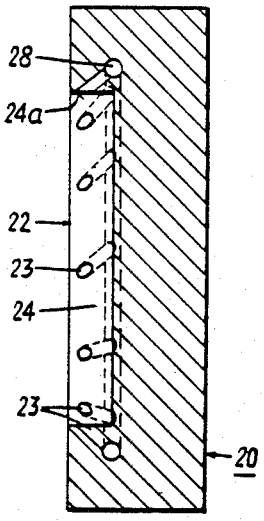

FIG. 5 is a cross-section view through a slider plate 20 in accordance with another embodiment of the device according to the invention. A circular recess or bore 24 is formed in the surface 22 of the slider plate and the gaseous medium is supplied via the annular duct 28 and the tangentially penetrating nozzles 23 to the cylindrical boundary wall 24*a* of the recess 24.

The diameter of the recess 24 is such that the boundary wall 24*a* of the recess 24 is situated in the region of the slider plate corresponding to the marginal zone 22*a* of the area 22 of FIG. 2.

As noted above, the benefits of the present invention are most advantageously achieved if the angles at which the nozzles direct the flow of gas are properly selected. It has been found that most effective results are attained if the nozzle 23 in the slider plate are oriented at an acute angle of from 3 to 45 degrees with the plate surface, and preferably in the range of from 10 to 30 degrees. In the headplate, the angle of the nozzles 13 with respect to the surface of the slider plate should be from 3 to 75 degrees, and preferably between 10 to 60 degrees.

Furthermore, while in the illustrated embodiments, all of the nozzles in the headplate or the slider plate are oriented to produce an orbital motion of the metal tending to move away from the slider plate, the benefits of the invention may be achieved with other orientations of the nozzles, as long as movement of the metal occurs adjacent the juncture of the headplate and the slider plate.

While the invention has been described with reference to preferred embodiments thereof, it will be understood by those skilled in the art that various changes in form and details thereof without departing from the spirit and scope of the invention.

We claim:

1. Apparatus for the continuous casting of metals comprising a container for molten metal to be cast, at least one discharge duct at the bottom of said container connecting with a horizontal continuous casting mold and a closure assembly in said duct, characterized in that said closure assembly comprises a substantially vertically disposed headplate fixed at one side thereof to said discharge duct facing said molten metal container, said headplate having a horizontally oriented bore therethrough aligned with said duct, said a substantially vertically disposed slider plate adapted to be moved across the other side of said headplate to block flow of molten metal through said bore to said mold, said slider plate having a plurality of nozzle openings in the surface of said slider plate facing said bore, said nozzle openings being disposed along a circular path adjacent to but smaller than the diameter of said bore, said nozzle openings being arranged to direct a gaseous medium at an angle of between 3 degrees to 45 degrees to said surface and substantially tangentially to said circular path.

2. The apparatus of claim 1 wherein the angle at which said nozzle openings in said slider plate direct said gaseous medium is between 10 and 30 degrees to said surface.

3. The apparatus of claims 1 or 3, further comprising a plurality of nozzle openings arranged in the wall of said bore in said headplate, said nozzle openings in said headplate bore directing a gaseous medium substantially tangentially of said wall and at an angle of from 3 degrees to 75 degrees to the surface of said slider plate.

4. The apparatus of claim 3 wherein the angle at which said nozzle openings in said headplate direct said gaseous medium is between 10 degrees to 60 degrees to said surface.

5. The apparatus of claim 1 further comprising a porous insert in said slider plate forming part of the surface thereof and means for supplying a gaseous medium to said insert.

6. The apparatus of claim 1 wherein a recess is provided in the surface of said slider plate facing said bore and of substantially the same diameter as said bore, and wherein there is further provided a plurality of nozzle openings in periphery of said recess for directing a flow of gaseous medium towards the plane of said surface and substantially tangentially of the periphery of said recess.

* * * * *

UNITED STATES PATENT AND TRADEMARK OFFICE

CERTIFICATE OF CORRECTION

PATENT NO. : 4,520,860

DATED : June 4, 1985

INVENTOR(S) : Manfred Haissig et al.

It is certified that error appears in the above-identified patent and that said Letters Patent is hereby corrected as shown below:

Col. 6, line 46, "claims 1 or 3" should read -- claims 1 or 2 --.

Signed and Sealed this

*Fifteenth* Day of *October 1985*

[SEAL]

*Attest:*

DONALD J. QUIGG

*Attesting Officer*

*Commissioner of Patents and Trademarks—Designate*